US006485323B2

(12) United States Patent
Henrie et al.

(10) Patent No.: US 6,485,323 B2
(45) Date of Patent: Nov. 26, 2002

(54) ADAPTER ASSEMBLY FOR HEATERS AND THE LIKE

(75) Inventors: John Henrie, Ogden, UT (US); Myron L. Jensen, Harrisville, UT (US); Steve U. Nestel, Ogden, UT (US); Randy C. Jarrett, Manua, UT (US)

(73) Assignee: Chromalox, Inc., Pittsburgh, PA (US)

( * ) Notice: Subject to any disclaimer, the term of this patent is extended or adjusted under 35 U.S.C. 154(b) by 0 days.

(21) Appl. No.: 09/753,872

(22) Filed: Jan. 3, 2001

(65) Prior Publication Data

US 2002/0086576 A1 Jul. 4, 2002

(51) Int. Cl.[7] ..... H01R 13/627
(52) U.S. Cl. ..... 439/359
(58) Field of Search ..... 439/359, 369, 439/521, 954, 361; 392/500, 449, 501, 441

(56) References Cited

U.S. PATENT DOCUMENTS

| | | | | |
|---|---|---|---|---|
| 4,721,480 A | * | 1/1988 | Yung | 439/527 |
| 6,069,998 A | | 5/2000 | Barnes et al. | 392/498 |
| 6,137,955 A | | 10/2000 | Krell et al. | 392/454 |

FOREIGN PATENT DOCUMENTS

| | | |
|---|---|---|
| AU | 199910024 A1 | 1/1999 |
| AU | 199914273 A1 | 2/1999 |
| AU | 199932254 A1 | 5/1999 |

* cited by examiner

*Primary Examiner*—P. Austin Bradley
*Assistant Examiner*—Phuong-Chi Nguyen
(74) *Attorney, Agent, or Firm*—Kirkpatrick & Lockhart LLP

(57) ABSTRACT

An adapter assembly for connecting a control unit to a heater. The control unit has wires that connect to terminals on the heater. The adapter assembly includes a first tubular body portion, a second tubular body portion and at least one locking bolt. The first tubular body portion is attached to the heater. The second tubular body portion is attached to the control unit. At least a portion of the first tubular body portion is retained inside the second tubular body portion. The locking bolt attaches the second tubular body portion to the first tubular body portion by inserting through a hole in the second tubular body portion. The present invention also includes an adapter assembly with the reverse attachments. Specifically, the first tubular body portion (retained inside the second tubular body portion) may be attached to the control unit instead of the heater. Similarly, the second tubular body portion may be attached to the heater instead of the control unit.

12 Claims, 8 Drawing Sheets

ADAPTER ASSEMBLY FOR HEATERS AND THE LIKE

FIELD OF THE INVENTION

The present invention relates generally to an adapter assembly for attaching a control unit to an electrical device such as a heater, and more particularly, to an adapter assembly that provides easy installation and orientation of the control unit.

BACKGROUND OF THE INVENTION

The heating of tanks and pipes is a common industrial practice that has many applications. Heating may be required to maintain a certain viscosity of heavy oils or resins that allow them to be readily pumped. Heating may also prevent crystalline precipitation or freezing during a process, or may simply facilitate the process itself.

Screw plug heaters with extending heating elements are used to heat fluids in a tank or reservoir. The heating elements are inserted through a threaded bore in the tank wall, and the screw plug of the heater is tightened within the bore. In this way, the heating elements extend within the tank, the screw plug seals the opening, and the electrical terminals for the heating elements lie outside the tank barrier.

It is common to connect a control unit for the heater directly outside the tank. In some instance, the control unit is attached directly to the heater. A conventional adapter assembly for attaching a control unit to a screw plug heater 10 is depicted in FIGS. 1A–1D. The solution uses a series of flanges and connection rings to attach the control unit to the screw plug heater 10. The screw plug heater 10 is threaded into a barrier or wall (not shown) so that the heating element 12 extends within a tank or reservoir (not shown). The terminals 14 of the heater 10 extend outside the barrier for connection to terminals 16 of a control unit.

To form the adapter assembly, the opposite ends of a mechanical tube 20 are fitted with a screw plug ring adapter 30 and a flange ring 40. The screw plug ring adapter 30 and flange ring 40 may be fixed to the ends of the mechanical tube 20 by welds or a strong metallic adhesive. The end of the mechanical tube 20 having the ring adapter 30 is used to connect the mechanical tube 20 to the screw plug heater 10. The end of the mechanical tube 20 having the flange ring 40 is used to connect the mechanical tube 20 to the back wall 60 of a control unit.

A clamp ring 50 is also used in the assembly. The clamp ring 50 has a hole 52 that slides over the exterior surface 22 of the tube 20. Accordingly, the hole 52 of the clamp ring 50 has a diameter slightly greater than the exterior surface 22 of the mechanical tube 20. The outer diameter of the clamp ring 50 is greater than the outer diameter of the flange ring 40.

After sliding the clamp ring 50 on the mechanical tube 20, the screw plug ring adapter 30 may be installed on the screw plug heater 10. The ring adapter 30 has an opening 32 to accommodate the terminals 14 of the screw plug heater 10. The ring adapter 30 is attached to the screw plug heater 10 by inserting screws 34 into one of two sets of holes 36, 38 of the ring adapter 30. The two sets of holes 36, 38 allow the adapter 30 to attach to different sized screw plug heaters.

With the mechanical tube 20 attached to the screw plug heater 10, the tube 20 is then attached to the back wall 60 of the control unit. The back wall 60 of the control unit has an opening 62 to accommodate wires of the control unit terminals 16. The back wall 60 is placed against the flange ring 40. Several bolts 64 are then inserted through access holes 66 in the back wall 60 and into holes 54 of the clamp ring 50. As a result, the flange ring 40 is sandwiched between the back wall 60 of the control unit and the clamp ring 50. The control unit hangs on the screw plug heater 10.

Several inefficiencies exist with conventional adapter assemblies. For example, the location of the access holes 66 in the back panel 60 of the control unit restricts the placement of internal components within the control unit. This results in ineffective use of space within the control unit. Moreover, installation and orientation of the control unit is difficult. The control unit must be opened to insert or remove bolts 64. Aligning the holes 54 in the clamp ring 50 with the access holes 66 in the back wall 60 of the control unit makes orientation of the control unit cumbersome.

The present invention is directed to overcoming, or at least reducing the effects of, one or more of the problems set forth above.

SUMMARY OF THE INVENTION

To that end, the present invention includes an adapter assembly for connecting a control unit to a heater. The control unit has wires that connect to terminals on the heater. The adapter assembly includes a first tubular body portion, a second tubular body portion and at least one locking bolt. The first tubular body portion is attached to the heater. The second tubular body portion is attached to the control unit. At least a portion of the first tubular body portion is retained inside the second tubular body portion. The locking bolt attaches the second tubular body portion to the first tubular body portion by inserting through a hole in the second tubular body portion.

The hole in the second tubular body portion may be a slot that enables the control unit to be radially oriented with respect to the first tubular body portion when installing and attaching the second tubular body portion to the first tubular body portion. The first tubular body portion may have threaded holes circumscribed on the outer surface of the first tubular body portion to receive the locking bolt. The first tubular body portion may also have locking wells circumscribed on the outer surface of the first tubular body portion to receive the locking bolt.

The present invention also includes an adapter assembly with the reverse attachments. Specifically, the first tubular body portion (retained inside the second tubular body portion) may be attached to the control unit instead of the heater. In this case, the second tubular body portion is attached to the heater.

In another embodiment, the present invention is an adapter assembly for connecting a first unit to a second unit. The first unit has an electrical terminal connecting to a wire in the second unit. The adapter assembly includes a first conduit and a second conduit. There is a means for attaching the first conduit to the first unit and a means for attaching the second conduit to the second unit. Moreover, the adapter assembly has a means for radially orienting the first unit with respect to the second unit and a means for attaching the first conduit to the second conduit once an orientation is selected.

In yet another embodiment, the present invention includes a method for joining a control unit having power wires to an electrical device having terminals. The method includes the steps of: attaching a first conduit to the control unit so that the power wires extend within the first conduit; attaching a second conduit to the electrical device so that the terminals of the electrical device extend within the second conduit;

connecting the power wires of the control unit to the terminals of the electrical device; inserting the second conduit into the first conduit; orienting the control unit radially with respect to the electrical device to a selected orientation; and maintaining the selected orientation by fastening the first conduit to the second conduit. The fastening may be done in a variety of ways including inserting a bolt through a locking slot in the first conduit and threading the bolt into a locking hole in the second conduit. The method may further include changing the attaching steps so that the first conduit is attached to the electrical device and the second conduit is attached to the control unit.

Another embodiment of the present invention is a kit containing parts of an adapter assembly for a heater. The kit includes: a first conduit capable of being attached to a heater; a second conduit capable of being attached to a control unit, the first conduit having a diameter so that it is capable of being retained inside the second conduit; and a plurality of locking bolts for attaching the second conduit to the first conduit.

The above summary of the present invention is not intended to represent each embodiment, or every aspect of the present invention. This is the purpose of the figures and detailed description that follows.

BRIEF DESCRIPTION OF THE DRAWINGS

Other objects and advantages of the invention will become apparent upon reading the following detailed description and upon reference to the drawings.

The foregoing and other aspects of the present invention will be best understood with reference to a detailed description of specific embodiments of the invention, which follows, when read in conjunction with the accompanying drawings, in which.

Figure 1A:
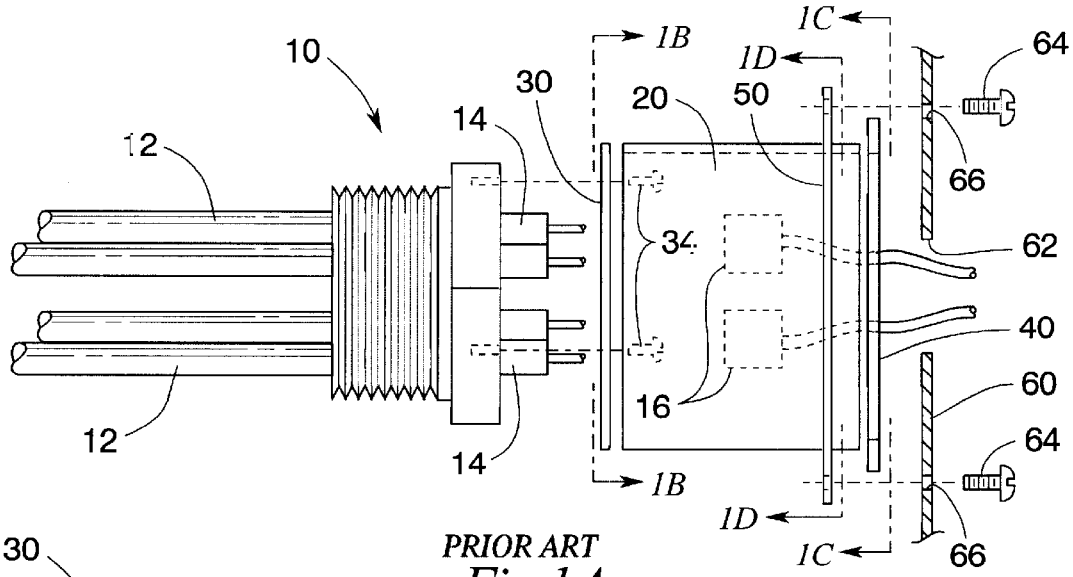
PRIOR ART Fig. 1A
FIGS. 1A–1D show a conventional, prior art adapter assembly for connecting a control unit to a screw plug of a heater.
Figure 1B:
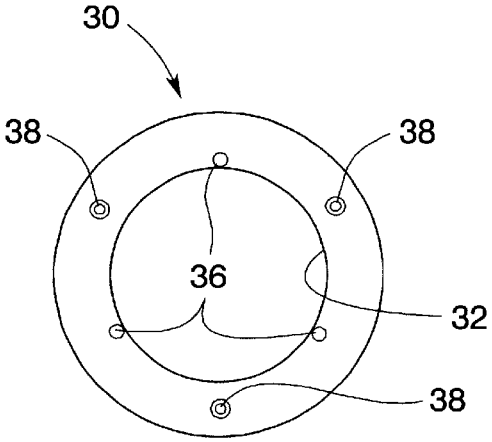
PRIOR ART Fig. 1B
Figure 1C:
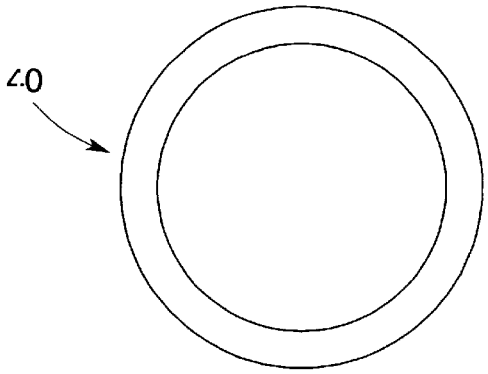
PRIOR ART Fig. 1C
Figure 1D:
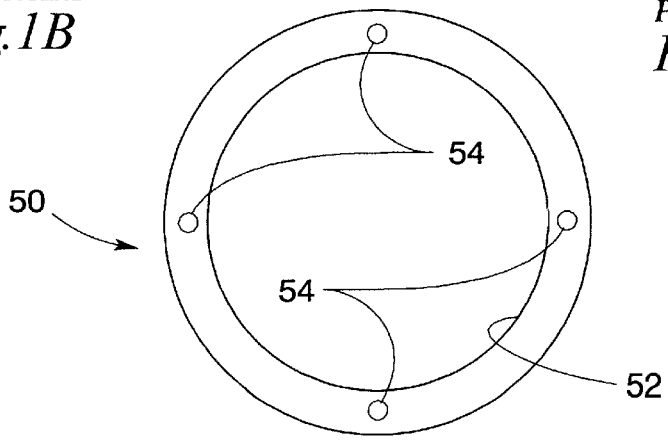
PRIOR ART Fig. 1D

While the invention is susceptible, to various modifications and alternative forms, specific embodiments have been shown by way of example in the drawings and will be described in detail herein. However, it should be understood that the invention is not intended to be limited to the particular forms disclosed. Rather, the invention is to cover all modification, equivalents and alternatives falling within the scope of the invention as defined by the appended claims.

DESCRIPTION OF ILLUSTRATIVE EMBODIMENTS

Figure 2A:
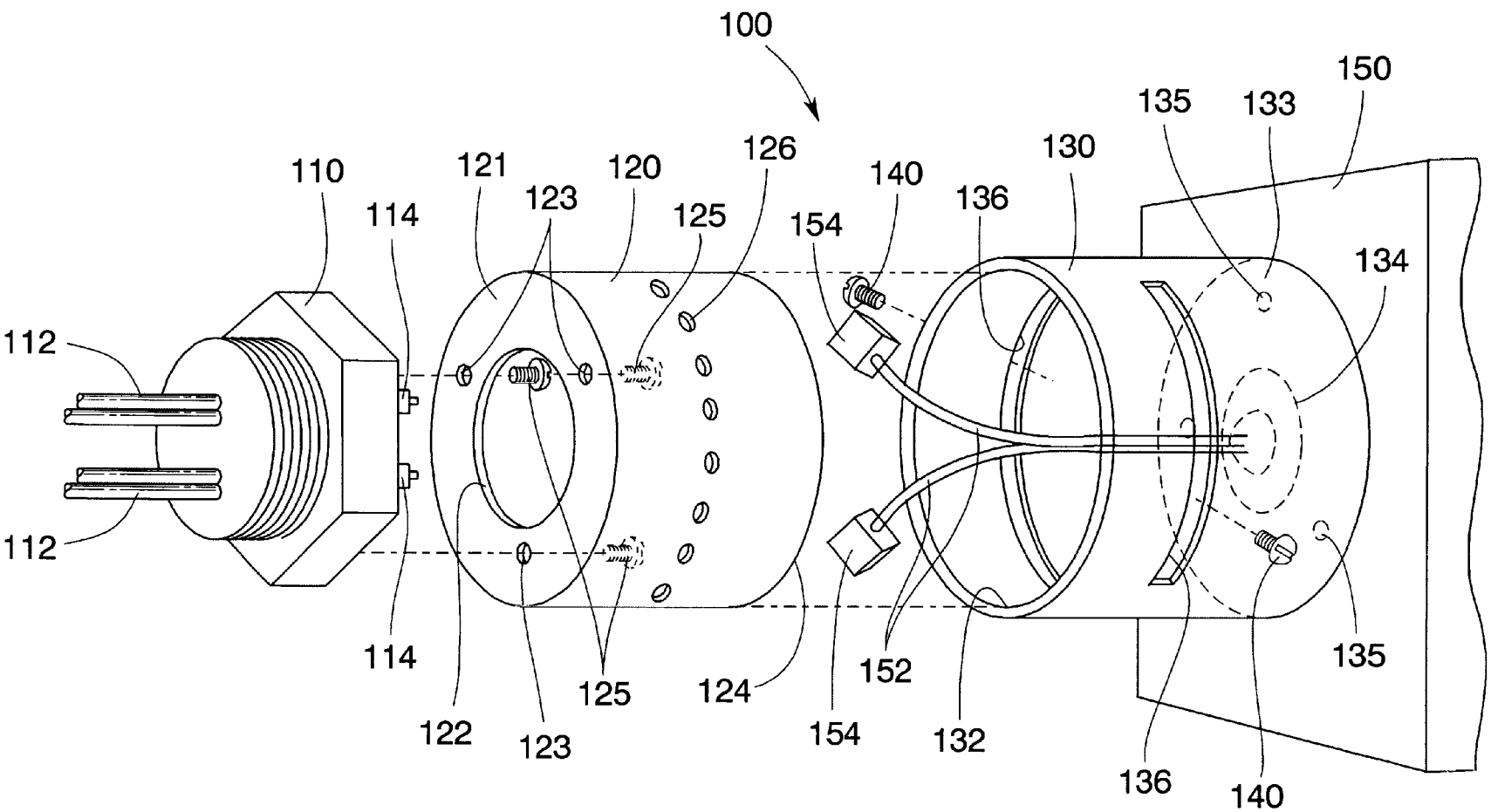
FIG. 2A is an exploded view of one embodiment of an adapter assembly according to the present invention.

Illustrative embodiments will now be described with reference to the accompanying figures. Turning to the drawings, FIG. 2A shows an exploded view of an adapter assembly 100 according to the present invention. A screw plug heater 110 has heater elements 112 for heating a process within a tank or reservoir (not shown). The screw plug heater 110 is threaded into an opening in the tank so that the heater elements 112 are contained within the tank. Outside the tank, terminals 114 extend from the screw plug heater 110 for attachment to a power supply and controls.

The adapter assembly 100 has an inner conduit 120 and an outer conduit 130. The adapter assembly 100 is used to attach the screw plug heater 110 to a control unit 150. In one embodiment, the inner conduit 120 of the adapter assembly 100 attaches to the screw plug heater 110. The inner conduit 120 has a inner flange 121 with an opening 122 to accommodate the extending terminals 114 on the screw plug 110. The inner flange 121 has screw holes 123. Screws or bolts 125 are inserted though the holes 123 and into the screw plug 110. Multiple sets of mounting holes may be provided to allow the adapter assembly 100 to function with standard sized plugs.

The inner conduit 120 has a second opening 124 at an opposite end. The inner conduit 120 also has a plurality of locking holes 126 that form a ring of holes that circumscribes the outer surface of the conduit 120. The locking holes 126 in one embodiment contain threads.

An outer conduit 130 of the adapter assembly 100 attaches to a control unit 150. The outer conduit 130 has an inner flange 133 with an opening 134 at its end to accommodate the wires 152 from the back of the control unit 150. The wires 152 extend through the conduit 130 and exit an opening 132 at an opposite end of the conduit 130. The wires 152 are provided with terminal connectors 154 for connection to the terminals 114 on the screw plug heater 110. The inner flange 133 has screw holes 135. Screws or bolts (not shown) are inserted though the holes 135 and into the back of the control unit 150.

The outer conduit 130 also has a plurality of locking slots 136 that form a ring of slots that circumscribes the outer surface of the conduit 130. The location of the locking slots 136 substantially encompasses the location of locking holes 120 when the outer conduit 130 axially installs on the inner conduit 120.

Although the present embodiment and other embodiments disclosed herein describe the use of mounting holes and screws for attaching the adapter portions to the screw plug and/or control unit, it is understood that a variety of ways to fasten the adapter portions to the screw plug or control unit exist. For example, the conduit portions can be welded to the screw plug or control unit. Also, a clamp ring, not unlike that discussed previously could be used to fasten the conduit to the screw plug. Other examples include: extruded flanges, welded flanges and nuts threaded onto bolts. Those skilled in the art having the benefit of this disclosure will readily conceive of alternative means for attaching the conduit portions to the screw plug or control unit. All such equivalents are applicable to the present invention.

The power and sensor wires 152 route through the conduits 120, 130 and attach to the terminals 114. The outer conduit 130 on the control unit 150 slips over the inner conduit 120 on screw plug heater 110. Once the two conduits 120, 130 are mated together, the control unit 150 may be rotated to any orientation around 360 degrees. The adapter facilitates 360 degrees of rotational adjustment to optimize the orientation of the attached control unit 150 for best functionality. Because the locking slots 136 align in axial depth along the two conduits 120, 130 with the locking holes 126, some of the redundant locking holes 126 remain accessible through the locking slots 136 despite radial movement of the outer conduit 130 with respect to the inner conduit 120.

It is understood that having the inner conduit 120 attach to the screw plug 110 and the outer conduit 130 attach to the control unit 150 is strictly an arbitrary designation. An equivalent embodiment exists having the reverse attachments. Specifically, the inner conduit 120 may attach to the control unit 150, while the outer conduit 130 may attach to the screw plug 110.

Although the present embodiments and others disclosed herein depict the adapter as having an inner and outer cylinder, other geometrical shapes for the conduits besides cylinders could still be used. These geometrical shapes could still allow for the conduits to fit over one another and provide for radial orientation of the two conduits with respect to one another. For example, both conduits could have complimentary conical shapes or bell-shapes. Other more exotic geometries exist that allow for the equivalent benefits of inserting one conduit into another and providing angular orientation of the conduits with respect to one another.

After situating the control unit 150 to a desired orientation, depending on the application and required location of the control unit 150, a plurality of locking bolts 140 insert through the locking slots 136 in the outer conduit 130. The locking bolts 140 thread into the locking holes 126 in the inner conduit 120. The control unit 150 is thus kept in place.

Figure 2B:
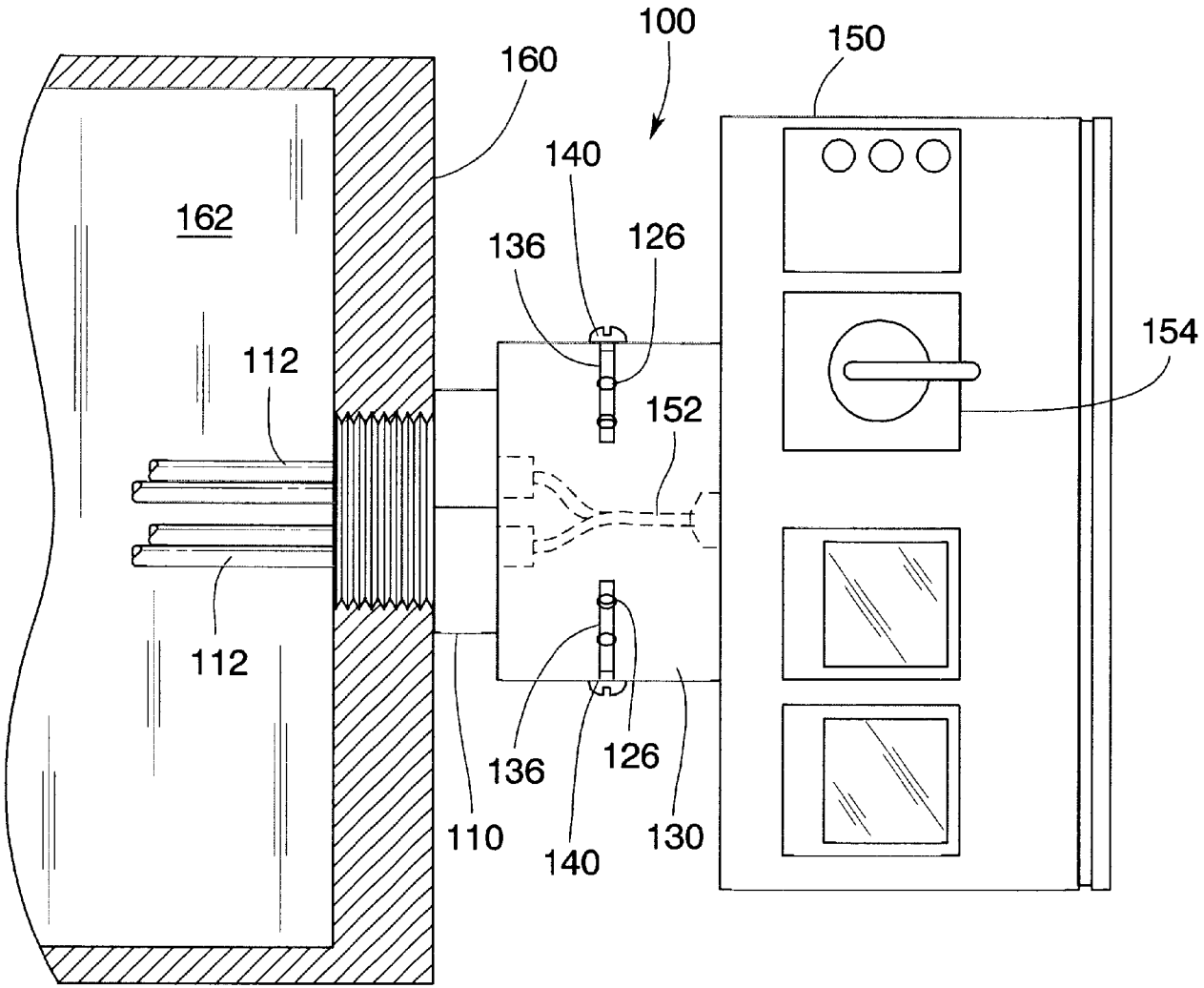
FIG. 2B is a side view of the assembled adapter in FIG. 2A.

FIG. 2B illustrates the embodiment of the present invention attaching a control unit 150 to a screw plug heater 110. The control unit 150 has a control panel 154 that is used to control the heating and sensing of a process 162. The control unit 150 is attached to the screw plug heater 110 by the adapter assembly 100.

The outer conduit 130 is shown attached to the back of the control unit 150. The outer conduit 130 sheathes the inner conduit (not visible in FIG. 2B). The bolts or screws 140 insert through the locking slots 136 and into locking holes 126. A number of redundant locking holes 126 are visible through the locking slots 136. In FIG. 2B, it is evident how the location of the locking holes 126 and locking slots 136 are readily accessible for attaching the bolts 140 and 142. A conventional tool, such as a screwdriver, ratchet or wrench may allow a user to easily access the bolts or screws 140 within the confined space between the control unit 150 and the barrier 160.

The adapter assembly 100 attaches to screw plug heater 110. The screw plug heater 110 is threaded into a bore in a barrier 160 so that heating elements 112 extend within a process 162. FIG. 2B also shows how the adapter assembly 100 provides a passageway for the electrical wires 152 from the control unit 150 to the screw plug heater 110. The sensor and power wires 152 pass through the adapter and connect to the terminals 114 in the screw plug heater 110.

The design of the adapter assembly 100 provides the redundant locking holes 126 with the ability to lock the device in place. All of the redundant holes 126 are not all typically used in the attachment of the two conduits of the adapter. The extra holes provide additional convenience when the orientation of any given hole is in an awkward position to be used to lock the adapter conduits together. Because the adapter assembly 100 acts as a support for the control unit 150, the number of redundant locking holes 126 and amount of missing material due to the locking slots 136 should not adversely effect the support capabilities of the adapter. Also, the cylindrical shape of the hollow tubes or conduits having a diameter of roughly 4" may help to overcome detrimental effects of the adapter supporting the control unit 150 in this manner.

Being attached and adjacent to a screw plug heater 110 in the side of a barrier 160, the adapter will be subject to heat conducted from the screw plug heater 110. Under increased thermal conditions, corrosion of metals can be more aggressive. Therefore, the adapter is ideally constructed of a corrosion resistant material such as 16GA stainless steel. In this way, the parts will not rust together over time.

When used with a fan cooled control unit 150, the redundant holes 126 may also allow a cooling airflow to pass through the adapter. The airflow passes from an opening (not shown) for the control wires 152 in the back of control unit 150, through the adapter and escapes through redundant, unused holes 126 and exposed slots 136. The adapter as a result is cooled by the airflow as are the power and sensor wires 152. The airflow can increase the thermal capabilities of the adapter. Therefore, the adapter may be used in applications that require higher thermal standards.

Figure 3A:
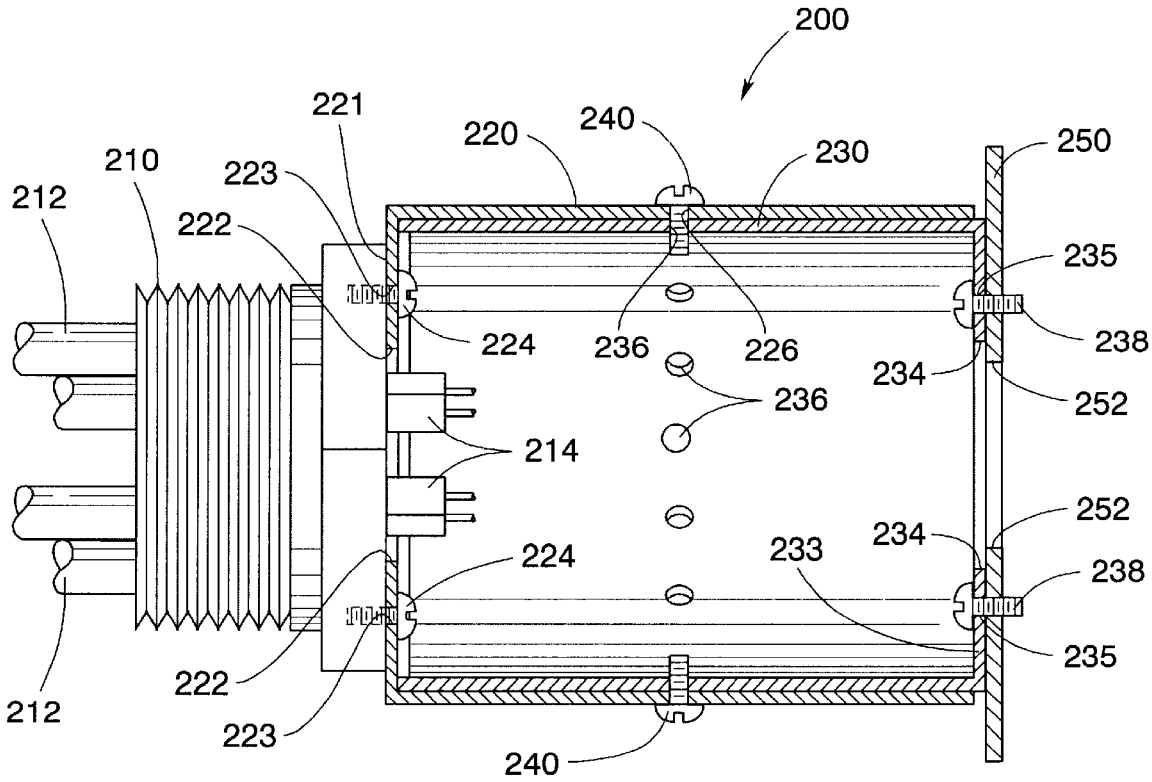
FIGS. 3A–B are sectional views of an alternative embodiment of an adapter assembly according to the present invention.

FIG. 3A shows a cross-sectional view of an alternative embodiment of a slip-on adapter assembly 200. In contrast to the description in FIGS. 2A–B, the conduit attached to the heater in FIG. 3A has a greater diameter than that of the conduit attached to the control unit. As can be seen in FIG. 3A, the heater 210 has heating elements 212 protruding therefrom. The outer conduit 220 has an inner concentric flange 221 that defines an opening 222 to accommodate the terminals 214 of a screw plug heater 210. The mounting holes 223 and bolts 224 in the flange 221 provide attachment of the outer conduit 220 to the screw plug heater 210.

The outer conduit 220 extends over the inner conduit 230. The inner conduit 230 in the present embodiment connects to the control unit 250. The inner conduit 230 uses a plurality of mounting holes 235 and bolts 238 in an inner concentric flange 233 to attach to the control unit 250. The inner conduit 230 also has an opening 234 to accommodate the control and power wires (not shown) from the control unit opening 252.

In FIG. 3A, the lateral alignment of the locking slots 226 with the locking holes 236 is emphasized. The inner conduit 230 and the outer conduit 220 are attached to one another by the locking bolts 240. For the slots 226 and holes 236 to align when the outer conduit 220 fits over the inner conduit 230, the slots 226 and holes 236 will ideally correspond to one another when the entire outer conduit 220 encompasses the inner conduit 230. Such alignment would require that the outer conduit 220 be of greater length than the inner conduit 230.

However, full encompassment of the inner conduit 230 by the outer conduit 220 may be unsuitable due to the thermal expansion of the two conduits in an application. If the outer conduit 220 encompasses the entire depth of the inner conduit 230 and snugly fits against the control unit 250 in order to align the slots 226 with the holes 236, disparate thermal expansion in the two conduits 220, 230 may present problems in a given application. For this reason, an amount of "play" or space may be necessary between the components so that the outer conduit 220 and inner conduit 230 are able to expand and contract with thermal variations.

Figure 3B:
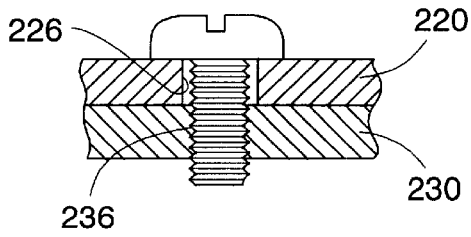

FIG. 3B shows an enlarged, cross-sectional view of a locking slot 226, locking hole 236 and screw 240 of the slip-on adapter assembly 200 in FIG. 3A. The outer conduit 220 has a locking slot 226. Adjacent to the outer conduit 220, the inner conduit 230 has a locking hole 236. A bolt or screw 240 fits through the locking slot 226 and threads into the locking hole 236.

Figure 4A:
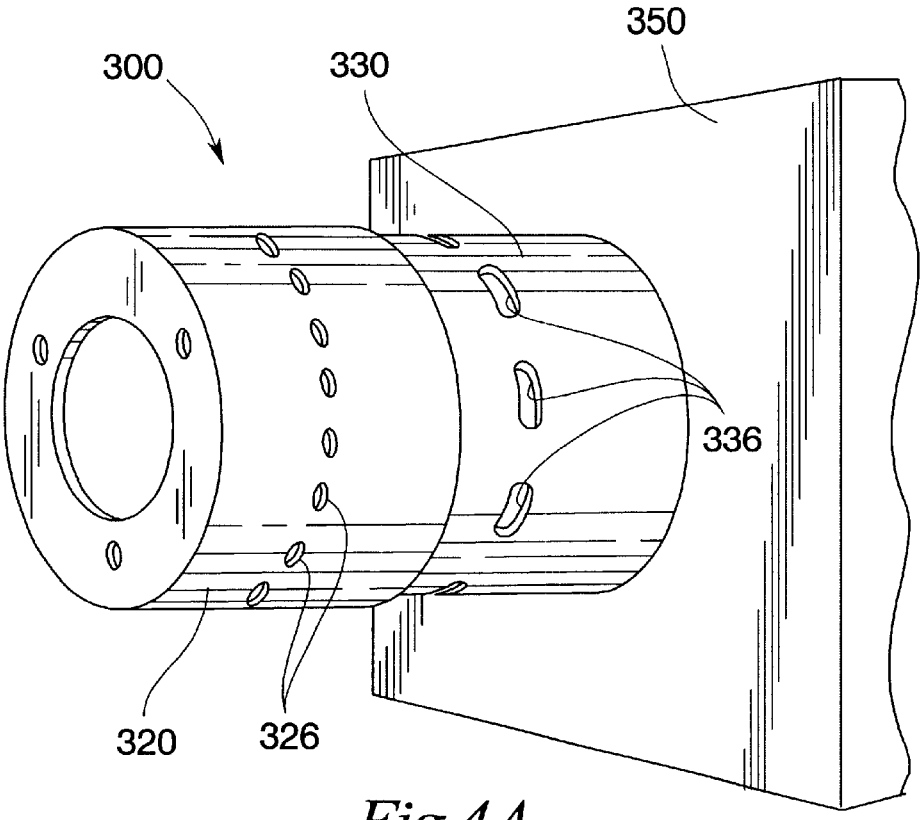
FIGS. 4A–B are perspective and sectional views of another embodiment of an adapter assembly according to the present invention.

FIG. 4A illustrates another embodiment of an adapter assembly 300 according to the present invention. An outer conduit 320 is shown partially installed over an inner conduit 330. The outer conduit 320 of the adapter has a series of locking holes 326 that circumscribe its exterior. When the outer conduit 320 fits over the inner conduit 330, these locking holes 326 align with locking wells 336. The locking wells 336 are a series of indentations that circumscribe the exterior of the inner conduit 330. A set of bolts 340 attach the outer conduit 320 and the inner conduit 330 together by threading into the locking holes 326 and tightening in the locking wells 336.

It should be noted that having locking slots on an outer conduit and locking holes on an inner conduit as depicted in previous embodiments is not a substantial requirement as provided by the present embodiment of FIG. 4A. The locking slots in the present embodiment define a locking well 336. By that definition, the meaning of the bolt holes that connect the two conduits together is broadened to include a hole, indentation or well in the surface of the conduits. These locking slots, a.k.a. locking wells 336, circumscribe the exterior surface of the inner conduit 330. Therefore, providing slots on one conduit and holes on another implies an equivalent embodiment having the reverse arrangement provided that the bolt holes on the conduits allow for the conduits to be fastened together.

Figure 4B:
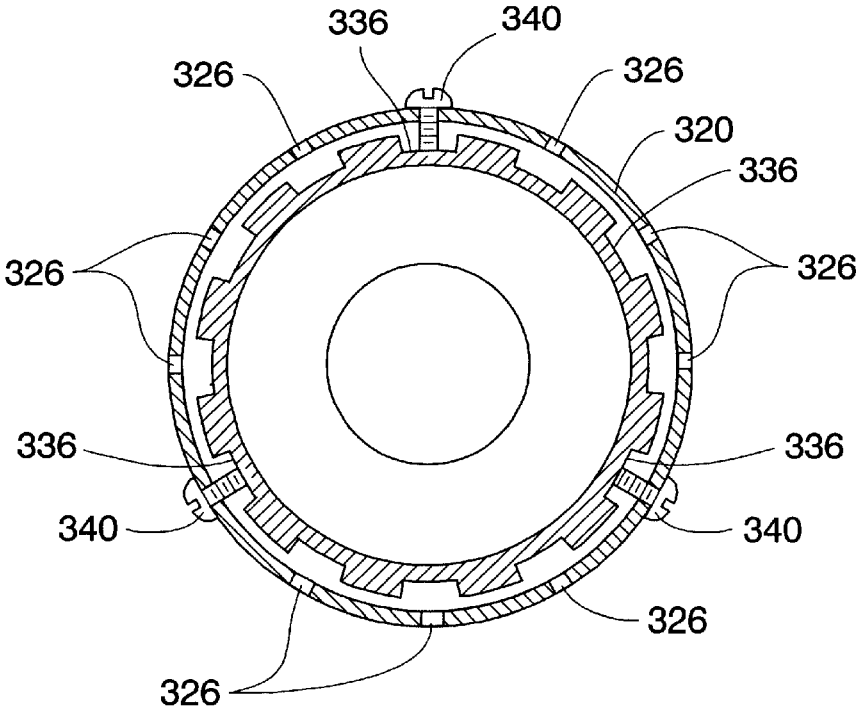

FIG. 4B shows a cross-sectional end view of the present embodiment of an outer conduit 320 installed over an inner conduit 330. The outer conduit 320 has a plurality of threaded locking holes 326. Within the outer conduit 320, the inner conduit 330 has a plurality of locking wells 336. The locking wells 336 defines an indentation in the surface of the inner conduit 330 that does not pass completely through the material.

A number of bolts or screws 340 threads into the locking holes 326 and fit into the locking wells 336. The bolts 340 are tightened in the locking holes 326 until they provide compressive force in the locking wells 336 on the inner conduit 330. The compressive force on the inner conduit 330 and the extension of the bolt in the locking well 336 both help maintain attachment of the inner conduit 330 and the outer conduit 320. In this way, the outer and inner conduits 320, 330 are substantially prevented from moving laterally or radially with respect to one another.

Figure 5A:
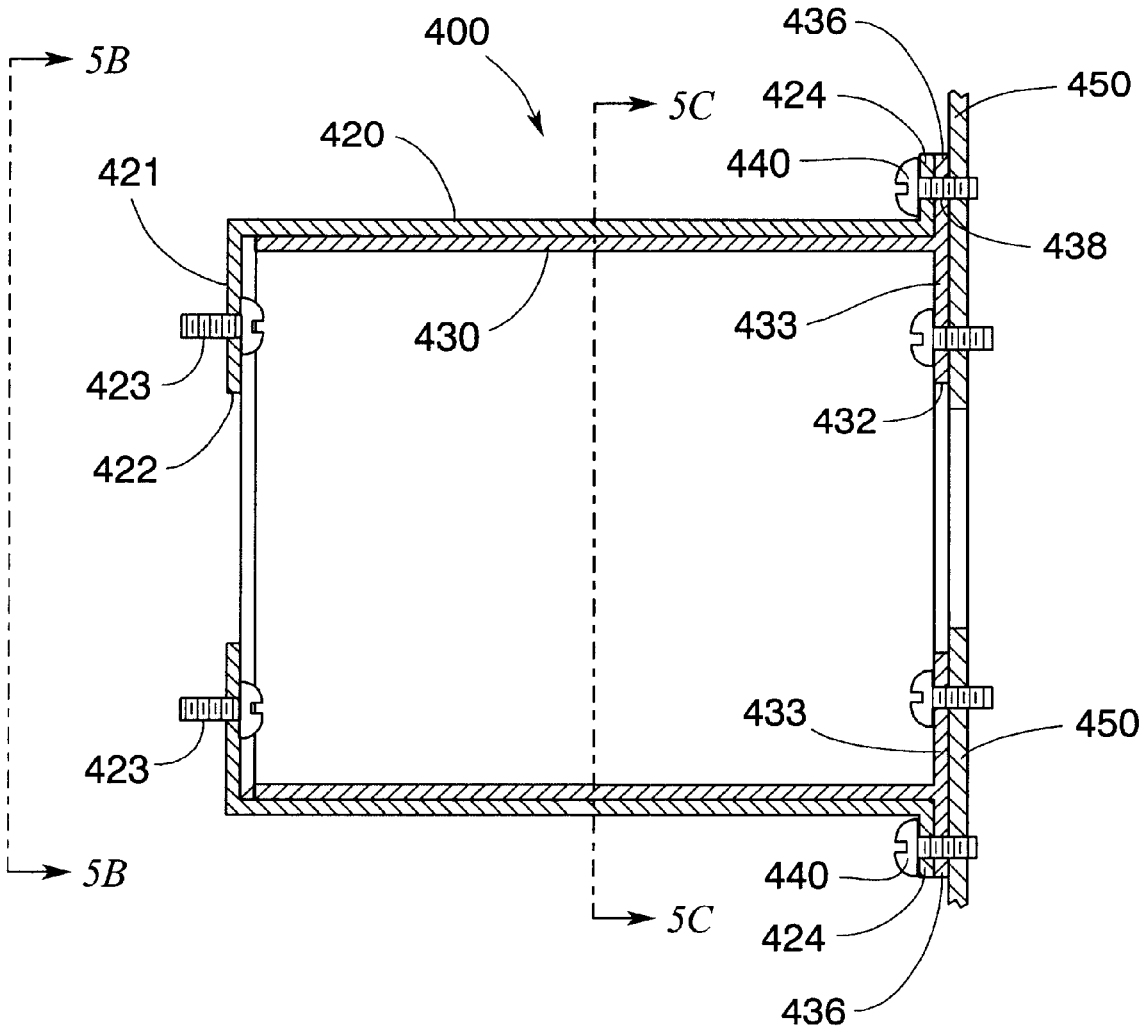
FIGS. 5A–5C are various views of another embodiment of an adapter assembly according to the present invention.

FIG. 5A illustrates a cross-sectional view of another embodiment of an adapter assembly 400 according to the present invention. At one end, an outer conduit 420 has a concentric inner flange 421. Either extruding or welding forms the flange 421. The flange 421 defines an opening 422 to accommodate the terminals of the screw plug heater (not shown). The flange 421 also has a series of mounting holes for attaching the outer conduit 420 to a screw plug heater (not shown). As stated previously, it is to be understood that a variety of fastening means is available to connect the conduit to the screw plug heater.

At an opposite end, the outer conduit 420 has a concentric outer flange 424. The flange 424 is formed by either extruding or welding. The flange 424 has a series of locking slots 426 that circumscribe its circumference.

The outer conduit 420 fits over an inner conduit 430. The inner conduit 430 has an opening 432 at one end to accommodate the control and power wires (not shown) from the control unit 450 that pass through the adapter to the screw plug heater (not shown). The opening 432 lies within a flange at the end of the inner conduit 430. The flange includes an inner concentric flange 433 and an outer concentric flange 436. The inner flange 433 has a series of threaded mounting holes for attaching the inner conduit 430 to control unit 450. The outer flange 436 has a series of locking holes 438 distributed around its circumference.

When the control unit 450 with attached inner conduit 430 is inserted into the outer conduit 420, the entire control unit 450 and inner conduit 430 can rotate in order to be properly situated for a given application. Redundant locking slots 426 align with locking holes 438, and a set of bolts 440 are used to lock the control unit 450 in position and sustain the unit 450 near the screw plug heater (not shown) that it controls.

Figure 5C:
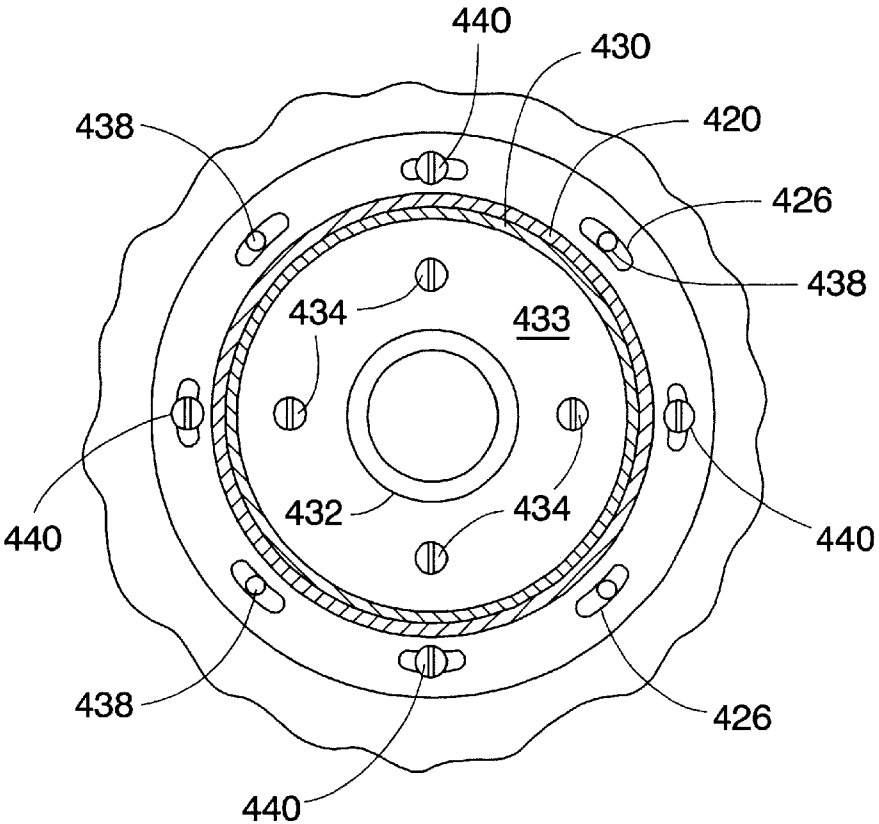
Figure 5B:
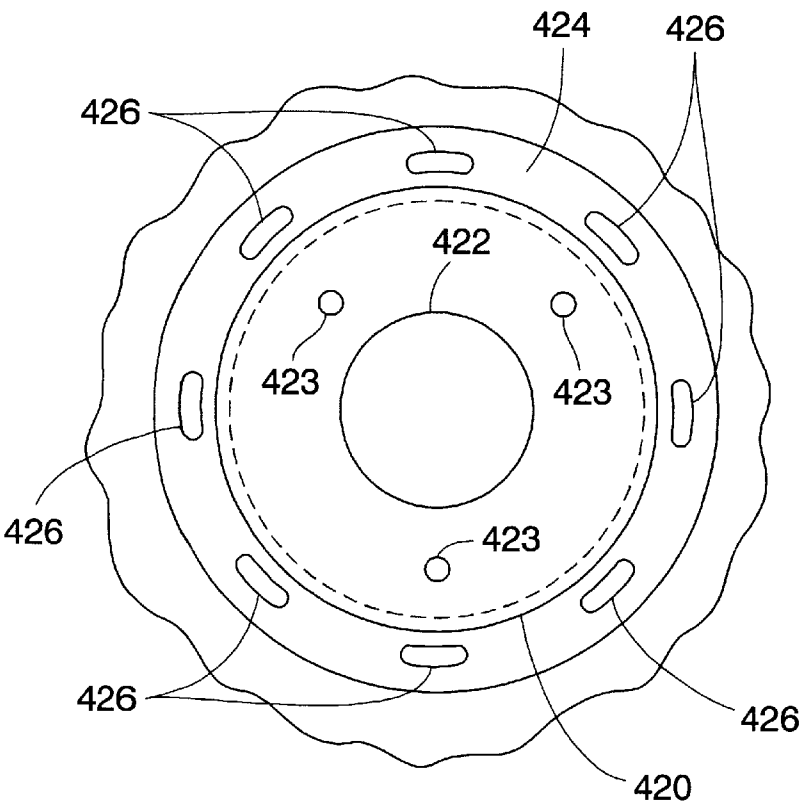

FIG. 5B shows a top-end view of the outer conduit 420 of FIG. 5A. The outer conduit 420 includes the cylindrical portion. At the lower end of the conduit lies concentric, outer flange 424. A series of redundant locking slots 426 circumscribe the surface of the flange 424.

FIG. 5C shows a top-end, cross-sectional view of the outer conduit 420 and inner conduit 430 of FIG. 5A. The inner conduit 430 includes the cylindrical portion having a diameter that is slightly less than that of the outer conduit 420 in FIGS. 5A and 5B.

At the lower end of the conduit lies the concentric inner flange 433 and the concentric outer flange 436. Within the inner flange 433 lies opening 432, and situated around the opening 432 lies a series of mounting holes 434 for securing the inner conduit 430 to the control unit. Circumscribing the outer flange 436 is a set of locking holes 438. When the outer conduit 420 of FIG. 5B fits over the inner conduit 430, the outer conduit 420 can be rotated to a desired orientation. The series of redundant locking slots 426 align with the locking holes 438 to allow the conduits 420, 430 to attach to one another.

Figure 6:
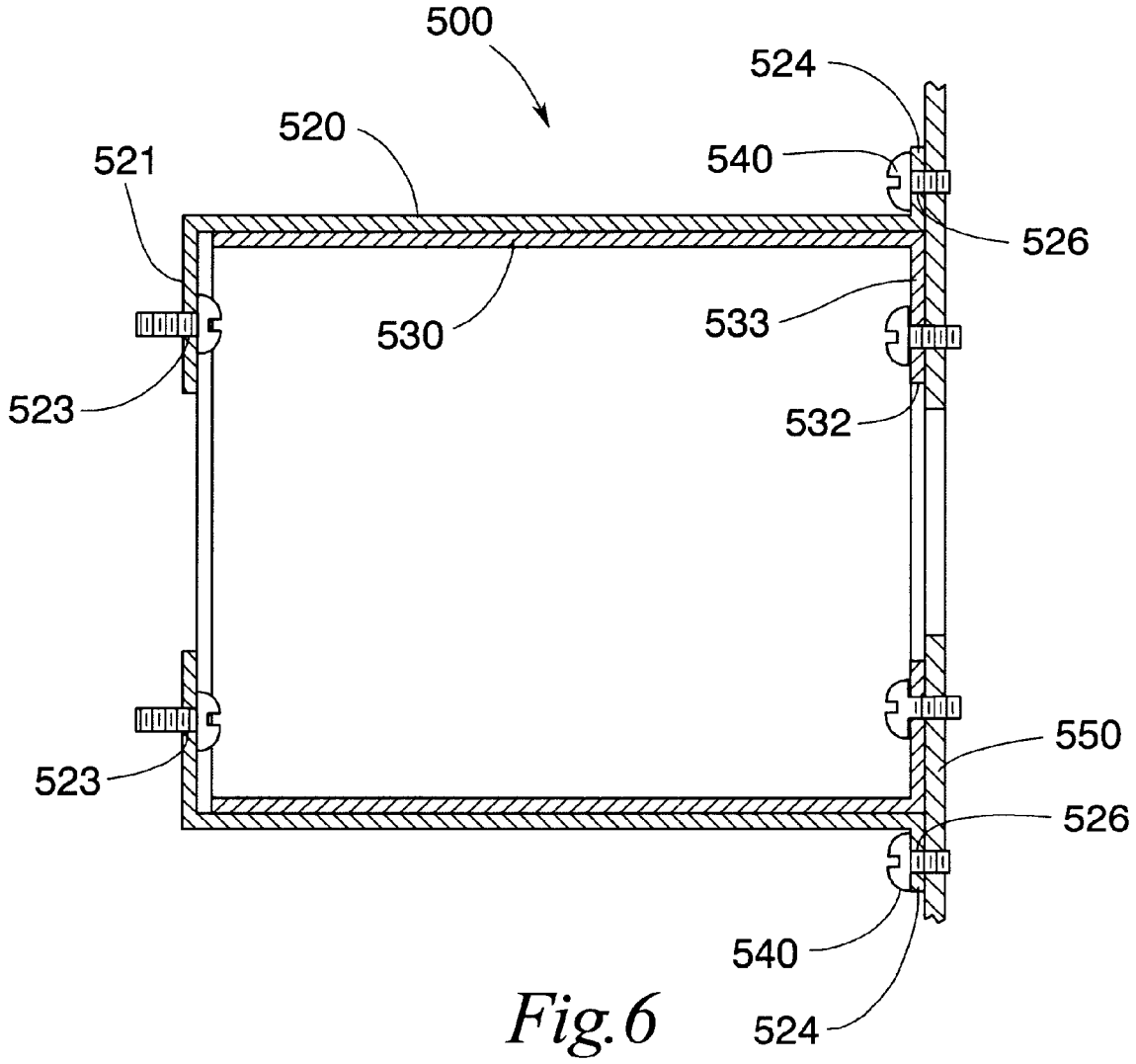
FIG. 6 is a sectional view of another embodiment of an adapter assembly according to the present invention.

FIG. 6 illustrates a cross-sectional view of another embodiment of an adapter assembly 500 according to the present invention. At one end, an outer conduit 520 has a concentric inner flange 521. The flange 521 defines an opening 522 to accommodate the terminals of the screw plug (not shown). The flange 521 also has a series of mounting holes and bolts 523 for attaching the outer conduit 520 to the screw plug (not shown). As stated previously, it is to be understood that a variety of fastening means is available to connect the conduit to the screw plug. At an opposite end, the outer conduit 520 has a concentric outer flange 524. The flange 524 has a series of locking slots 526 that circumscribe it circumference.

An inner conduit 530 fits into outer conduit 520. The inner conduit 530 has an opening 532 at one end to accommodate the control and power wires (not shown) from the control unit 550. The opening 532 lies within an inner, concentric flange 533. The inner flange 533 has a series of threaded mounting holes for attaching the inner conduit 530 to the control unit 550.

When the inner conduit 530 with attached control unit 550 is inserted into the outer conduit 520 with attached to the screw plug heater (not shown); the entire unit 550 can rotate in order to be properly situated for a given application. Redundant locking slots 526 align with locking holes in control unit 550. A set of bolts 540 is used to lock the unit in position and hold the control unit 550 to the screw plug heater on a tank or reservoir.

The present invention also includes a method for joining a control unit having power and control wires to a screw plug heater having terminals. Of course, during implementation of any method, a number of specific problems may warrant additional steps or even the negation of steps in the method. The method presented here offers a skeleton for what may be accomplished in the field.

A first conduit attaches to the control unit so that the power and control wires extend within the first conduit. The conduit can be connected during manufacture of the unit or retrofitted later in the field. A second conduit attaches to the screw plug heater so that the terminals extend within the second conduit. The screw plug heater may already be in use and installed in a barrier, or it may be installed after the conduit is attached.

When the control unit is ready to be installed on the screw plug heater, the power and control wires from the control unit connect to the terminals on the screw plug heater. The first conduit inserts into the second conduit. The reverse is also possible depending on which conduit has the larger diameter. An operator turns the control unit with the second conduit situated on the first conduit. The control unit orients radially with respect to the screw plug heater.

Once a desired position is achieved, fastening the first and second conduits relative to one another maintains the radial orientation. The fastening of the two conduits may be accomplished a number of ways, but all involve a simple procedure of an operator threading a set of screws into slots and holes that are easily accessible in the conduits. For example, a set of bolts may insert through locking slots in the second conduit and thread into locking holes in the first conduit. On the other hand, a set of bolts may insert through locking holes in the second conduit and tighten in locking wells in the first conduit. Or additionally, a set of bolts may insert through locking slots in a flange on the second conduit and tighten into locking holes in the control unit. Thus, the adapter supports the control unit to the screw plug heater and acts as a protective conduit for the control and power wires.

While the invention has been described with reference to the preferred embodiments, obvious modifications and alterations are possible by those skilled in the related art. Therefore, it is intended that the invention include all such modifications and alterations to the full extent that they come within the scope of the following claims or the equivalents thereof.

What is claimed is:

1. An adapter assembly for connecting a control unit to a heater, the control unit having wires that connect to terminals on the heater, the adapter assembly comprising:

a first tubular body portion attached to the heater;

a second tubular body portion attached to the control unit, at least a portion of the first tubular body portion being retained inside the second tubular body portion, the second tubular portion having at least one circumferential slot therethrough; and at least one locking bolt attaching the second tubular body portion to the first tubular body portion, the locking bolt inserted through the circumferential slot in the second tubular body portion, enabling the control unit to be rotated with respect to the first tubular body portion when installing and attaching the second tubular body portion to the first tubular body portion.

2. The adapter assembly of claim 1, wherein the first tubular body portion has at least one threaded hole to receive the at least one locking bolt.

3. The adapter assembly of claim 1, wherein a plurality of threaded holes circumscribes an outer surface of the first tubular body portion, at least one of the plurality of threaded holes receiving the at least one locking bolt.

4. The adapter assembly of claim 1, wherein the first tubular body portion has an inner flange for attaching to the heater.

5. The adapter assembly of claim 1, wherein the second tubular body portion has an inner flange for attaching to the control unit.

6. A heating apparatus, comprising:

a heater having at least one heating element and at least one power wire protruding therefrom;

a first body portion attached to the heater;

a second body portion attached to a heater control unit that is electrically coupled to said at least one power wire, at least a portion of the first body portion being retained inside the second body portion; and at least one locking bolt attaching the second body portion to the first body portion, the locking bolt inserted through a hole in the second body portion.

7. The heating apparatus of claim 6, wherein the hole in the second body portion is a slot that enables the control unit to be selectively radially oriented with respect to the first body portion.

8. The heating apparatus of claim 6, wherein the first body portion has at least one threaded hole to receive said at least one locking bolt.

9. The heating apparatus of claim 6, wherein a plurality of threaded holes circumscribes an outer surface of the first body portion, at least one of the plurality of threaded holes receiving the at least one locking bolt.

10. The heating apparatus of claim 6, wherein the first body portion has an inner flange attached to the heater.

11. The heating apparatus of claim 6, wherein the second body portion has an inner flange attached to the control unit.

12. An apparatus for heating a medium supported in the interior of a tank that has an exterior, the apparatus comprising:

a heating element attachable to a portion of the tank such that the heating element extends into the interior of the tank and at least one power wire protrudes out of the exterior of the tank;

a control unit electrically coupled to said at least one power wire, the control unit coupled to an adapter that is affixed to the heating element such that the adapter permits the control unit to be selectively rotated relative to the heating element to one of a plurality of positions; and a retainer on the adapter to retain the control unit in said one of a plurality of positions.

* * * * *